United States Patent [19]

Johnson

[11] Patent Number: 4,524,728

[45] Date of Patent: Jun. 25, 1985

[54] STEAM CONDENSING APPARATUS

[75] Inventor: Benjamin M. Johnson, Kennewick, Wash.

[73] Assignee: Electric Power Research Institute, Inc., Palo Alto, Calif.

[21] Appl. No.: 512,342

[22] Filed: Jul. 25, 1983

[51] Int. Cl.[3] ..... F22G 1/00

[52] U.S. Cl. ..... 122/459; 165/147; 165/166

[58] Field of Search ..... 122/421, 422, 32; 165/459, 166, 147

[56] References Cited

U.S. PATENT DOCUMENTS

| | | | |
|---|---|---|---|
| 1,152,421 | 9/1915 | Killman | 122/422 X |
| 1,948,541 | 2/1934 | Noack | 165/147 X |
| 3,847,211 | 11/1974 | Fischel et al. | 165/166 |
| 4,081,025 | 3/1978 | Donaldson . | |
| 4,148,357 | 4/1979 | Forster et al. . | |
| 4,184,536 | 1/1980 | Smith et al. . | |
| 4,216,820 | 8/1980 | Andrew . | |
| 4,274,481 | 6/1981 | Ireland et al. . | |
| 4,282,834 | 8/1981 | Anderson . | |
| 4,297,775 | 11/1981 | Butt et al. . | |

*Primary Examiner*—Edward G. Favors

*Attorney, Agent, or Firm*—Flehr, Hohbach, Test, Albritton & Herbert

[57] ABSTRACT

An apparatus for condensing steam is disclosed herein. This apparatus includes a group of individually removable modules, each of which uses a series of spaced-apart confronting plates to define passageways for the steam to be condensed and ammonia which serves as the condensing medium. As the steam moves in one direction through designated passageways, liquid ammonia moves in the opposite direction in other designated passageways. The liquid ammonia causes the steam to condense which, in turn, causes the liquid ammonia to be reduced to a vapor which itself is condensed at a remote location for repeating the process.

12 Claims, 9 Drawing Figures

STEAM CONDENSING APPARATUS

The present invention relates generally to techniques for condensing steam and more particularly to a specifically designed modularized steam condensing apparatus utilizing ammonia as its condensing medium.

Condensing of steam in thermal power plants is generally accomplished through the use of circulating cooling water, either with a once-through arrangement from a river, lake or other large body of water; or with a recirculating arrangement in which the water is cooled by the air either in direct contact and primarily by evaporation of a portion of the water (wet cooling), or in a heat exchanger without contact or evaporation of any water (dry cooling). Concern for growing shortages of water is causing electric utilities to give increasing consideration to this latter type of cooling, i.e., dry cooling, despite the high cost associated with it.

One way that is presently being studied to check the high costs of dry cooling is to use ammonia to transport the waste heat from the power plant (i.e., from the turbine condenser) to the air cooled heat exchanger in a cooling tower. Condensing the steam by boiling ammonia (instead of heating water) and then condensing the ammonia in the cooling tower results in the use of smaller equipment and less power. This concept has been compared with state of the art dry cooling and appears to be from 25% to 40% less expensive. It is presently being tested on a small scale, e.g., about 15MWe.

The equipment used in this test or demonstration to condense the turbine exhaust and boil the ammonia is very similar to the conventional shell-and-tube condensers. In these latter arrangements, a relatively large number of parallel tubes are supported within a condensing chamber by a series of upstanding plates. The chamber is intended to receive the steam to be condensed and the tubes are configured to pass the condensing medium, for example ammonia. However, the use of the ammonia at moderate pressures (approximately 350psi) introduces some features (high pressure "plenum" construction and fixed/heavy tube sheets) which may be difficult to design into very large units, without extensive (and expensive) manifold piping.

In view of the difficulties just recited associated with the use of the conventional shell-and-tube condenser with ammonia as the condensing medium, it is an object of the present invention to provide a steam condensing apparatus which utilizes ammonia as its condensing medium without incurring such difficulties.

A more particular object of the present invention is to provide an ammonia-cooled steam condensing apparatus which is relatively uncomplicated in design and reliable in use.

Another particular object of the present invention is to provide an ammonia-cooled steam condensing apparatus which is relatively easy to maintain and repair.

Still another particular object of the present invention is to provide an ammonia-cooled steam condensing apparatus which is relatively compact in design, that is, which physically requires a relatively small volume of space while, at the same time, providing a relatively large surface contact area for the steam being condensed and the ammonia which is doing the condensing.

Yet another particular object of the present invention is to provide a steam condensing apparatus which reliably condenses all of the steam passing through it and which, at the same time, reliably removes the non-condensables within the steam, typically air, from the apparatus as the steam moves therethrough.

Still another particular object of the present invention is to provide an ammonia-cooled steam condensing apparatus which passes steam in one direction through it and ammonia in the opposite direction and which is configured to provide relatively low pressure drops across its steam and ammonia inlet and outlets.

A further specific object of the present invention is to provide a steam condensing apparatus having relatively high structural integrity which in large part results from the same means used to provide its relatively large surface contact area between the steam and ammonia as compared to its physical volume.

As will be seen hereinafter, the steam condensing apparatus disclosed herein includes housing means defining inlet plenums for the steam and liquid ammonia and outlet plenums for the resulting water and ammonia vapor. The apparatus also includes means for supporting a number of thermally conductive sheets in spaced-apart confronting relationship to one another within the housing means so as to define therebetween a plurality of steam providing passageways between the steam/water plenums and a plurality of ammonia providing passageways between the liquid/vapor ammonia plenums. Steam is passed through its associated passageways, preferably in one direction, while liquid ammonia is passed through its associated passageways, preferably in the opposite direction. As this takes place, the steam is condensed by being exposed to the colder ammonia liquid and the liquid ammonia is caused to boil as a result of the heat it receives from the steam. In the power-generation facility, the condensed water is converted to steam again by heat from the fuel, e.g. from a fossil-fueled boiler or a nuclear reactor, and then used as a means for powering a steam turbine. The ammonia after condensing the steam and forming a vapor is itself condensed at a remote location and reused in liquid form as a steam condensing medium.

In a preferred embodiment of the present invention, the steam condensing apparatus disclosed herein utilizes a number of individually removable modules each of which contains the thermally conductive sheets and passageways just recited. In this way, the overall apparatus, though it might be physically quite large, is relatively easy to maintain. In this same preferred embodiment, each of the passageways carrying steam or ammonia is divided into a number of sub-passages by means of a suitably designed corrugated sheets therein. These corrugations serve not only to add structural integrity to the overall apparatus but they substantially increase the surface to surface contact area between the steam and ammonia to insure that the overall apparatus operates efficiently. At the same time, the sub-passages are preferably disposed vertically with the steam moving downward so as to carry non-condensables with it (a difficult problem in a conventional shell-and-tube arrangement with an isothermal system). As the steam moves downward, the ammonia moves upward. In initially doing so, the ammonia enters its passageways entirely as a liquid (e.g. in a sub-cooled state) so as to further aid in the localizing of the non-condensables on the steam side for their removal from the apparatus, for example, by means of a plant ejector system.

Other features of the ammonia-cooled steam condensing apparatus disclosed herein will be described in more detail hereinafter in conjunction with the drawings wherein.

Figure 1:
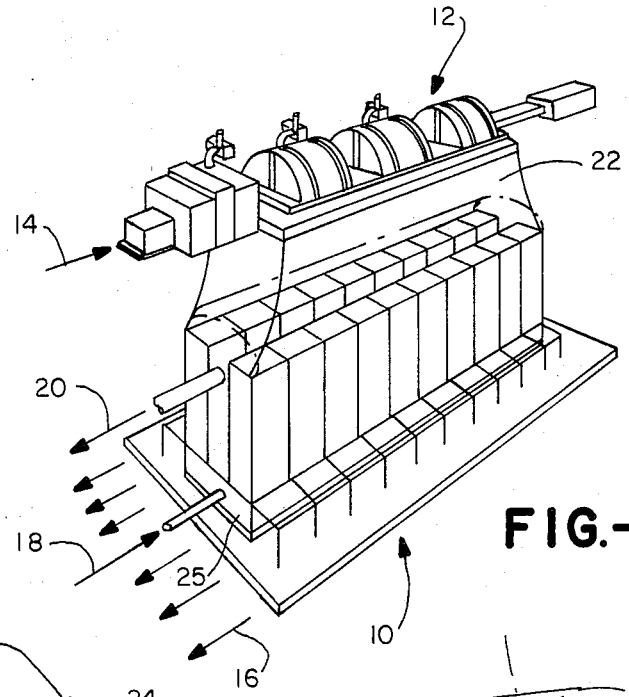
FIG. 1 is a perspective view of the steam condensing apparatus designed in accordance with the present invention shown cooperating with a steam turbine.

Turning now to the drawings, wherein like components are designated by like reference numerals throughout the various figures, attention is first directed to FIG. 1. As seen there, a steam condensing apparatus generally indicated at 10 is shown in combination with a steam turbine 12. As will be described in more detail hereinafter, apparatus 10 is designed to receive steam, for example from the steam turbine, and, at the same time, it is designed to receive liquid ammonia from, for example, an ammonia condensing cooling tower (not shown). The ammonia serves to condense the steam received at apparatus 10 and, as a result, is expanded to a vapor and returned to the cooling tower. The water resulting from the condensed steam is removed from the apparatus. This water is again vaporized to steam in the power-generating facility's heat source and is then used to drive turbine 12. In FIG. 1, arrow 14 represents the steam entering turbine 12, arrows 16 represent the condensed water leaving apparatus 10, and the arrows 18 and 20 represent liquid ammonia entering the steam condensing apparatus and vapor ammonia leaving it, respectively.

Figure 2:
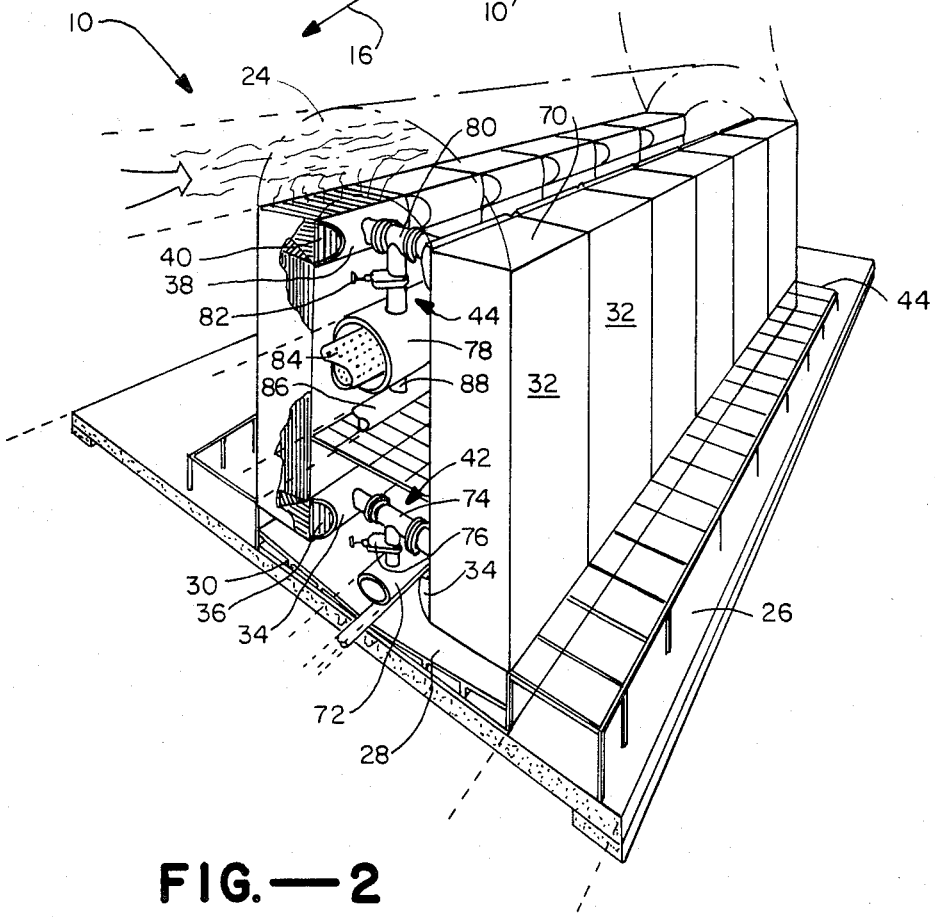
FIG. 2 is an enlarged, partially broken away, perspective view of the steam condensing apparatus illustrated in FIG. 1, specifically illustrating a number of individually removable steam condensing modules forming part of the overall apparatus.
Figure 3:
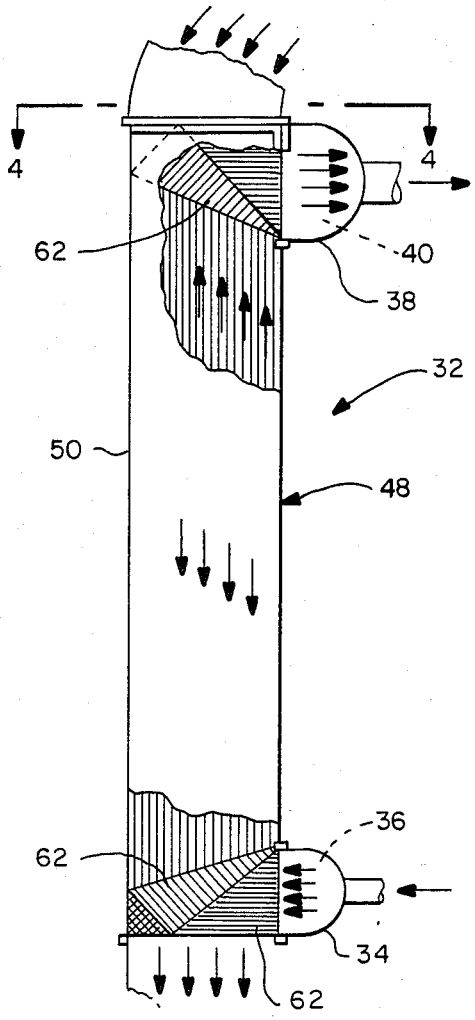
FIG. 3 is a side elevational view of one of the steam condensing modules shown in FIG. 2.
Figure 4:
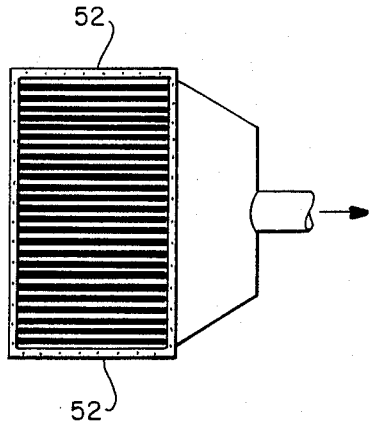
FIG. 4 is a downwardly sectional view of the module illustrated in FIG. 3, taken generally along line 4—4 in FIG. 3.
Figure 5:
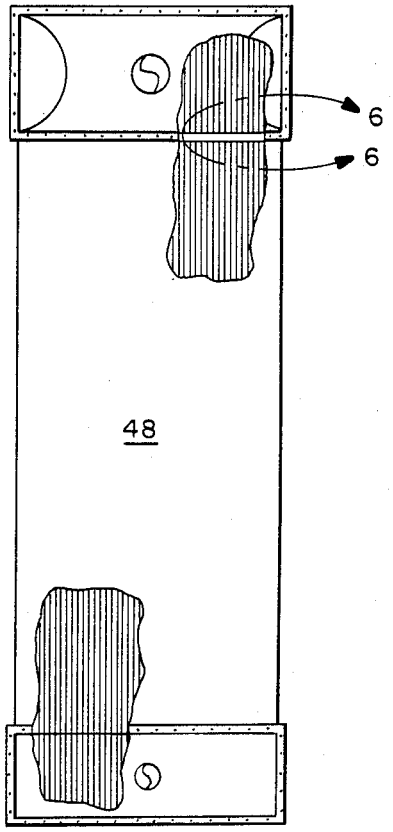
FIG. 5 is a front elevational view of the steam condensing module illustrated in FIG. 3.
Figure 6:
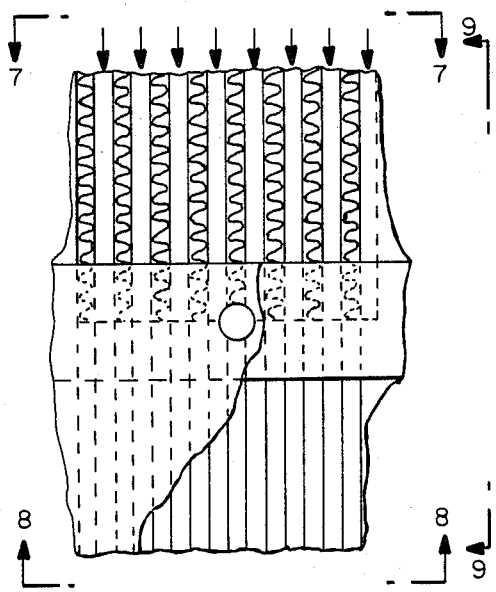
FIG. 6 is an enlarged view illustrating a detail of the steam condensing module shown in FIG. 5, taken generally within the imaginary circle illustrated in FIG. 5.
Figure 7:
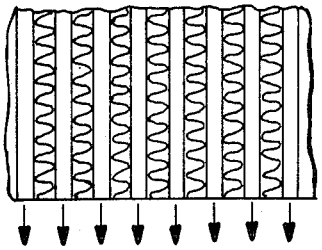
FIG. 7 is a sectional view of the detail illustrated in FIG. 6, taken generally along line 7—7 in FIG. 6.
Figure 8:
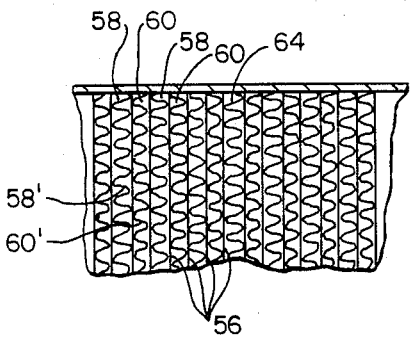
FIG 8 is a sectional view of the detail illustrated in FIG. 6 taken generally along line 8—8 in FIG. 6.
Figure 9:
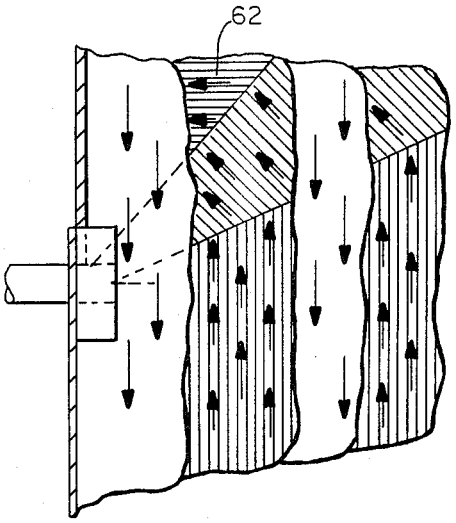
FIG. 9 is a side elevational view of the detail illustrated in FIG. 6.

Turning to FIG. 2, attention is now directed to the steam condensing apparatus 10 in detail. As seen there in conjunction with FIG. 1, the apparatus includes an uppermost housing 22 (see FIG. 1) defining a single, horizontally extending top inlet plenum 24 (see FIG. 2) for receiving steam from turbine 12. The apparatus also includes a lowermost housing 25 (again see FIG. 1) which sits directly over a horizontally extending support slab 26 and which defines a hot water well 28 (FIG. 2) serving as an outlet plenum for the water resulting from the condensing steam. The entire steam condensing apparatus 10 including water well 28 is supported on slab 28 by a riblike structural arrangement 30.

In addition to inlet plenum 24 and hot water well 28, overall steam condensing apparatus 10 includes a number of individual steam condensing modules 32 which are rectangular in configuration and which extend vertically between the steam receiving inlet plenum 24 and hot water well 28. As shown in FIG. 2, overall apparatus 10 includes twelve such modules in two spaced-apart rows of six. As will be described in more detail hereinafter, each module is designed to direct steam from plenum 24 in a vertically downward direction toward hot water well 28. At the same time, liquid ammonia is directed into and through each module from its bottom end to its top end for condensing the steam as the latter moves downward. To this end, overall apparatus 10 also includes bottom housing shells 34, each of which defines a horizontally extending liquid ammonia receiving inlet plenum 36 associated with each steam condensing module and corresponding upper shells 38, each of which defines a horizontally extending outlet plenum for ammonia vapor associated with each module. The upper and lower shells in each row cooperate with one another to form a longer, continuous plenum across the row. A conduit arrangement 42 serves to deliver liquid ammonia into inlet plenums 36 and a second conduit arrangement 44 serves to remove ammonia vapor from plenums 40. The liquid ammonia may be received from any suitable source and the ammonia vapor may be delivered to any suitable condensing arrangement. For example, as indicated above, a separate cooling tower for condensing ammonia vapor may be utilized to form a closed loop between ammonia vapor outlet plenums 40 and liquid ammonia inlet plenums 36.

Still referring to FIG. 2, overall steam condensing apparatus 10 is shown including two rows of support racks 44 extending up from and supported by slab 26. These racks serve to support the steam condensing modules 32 for individual movement between their operating positions illustrated in FIG. 2 and positions out from under steam inlet plenum 24. In this way, each module can be readily removed from the rest of the apparatus for maintenance and repair. Obviously, some form of suitable mechanical means (not shown) would be necessary to physically move each module which is supported on its own associated rack by means of low pressure seals (not shown) necessary to seal the module in its operating position over hot water well 28.

Turning now to FIGS. 3-9, attention is directed to one of the steam condensing modules 32. As seen best in FIGS. 3-5, this module includes a rectangular outer housing 46 which is opened at its top end (see FIG. 4) and at its bottom end and which is comprised of a front panel 48, a back panel 50 and two side panels 52 forming a vertically extending, rectangular cross-section. A number of thermally conductive sheets 54 are fixedly connected within housing 46 in spaced-apart confronting relationship to one another and parallel to side panel 52 so as to define a first group of passageways 58 and a second group 60 disposed between passageways 58. The entrances and exits of these passageways are formed by the members that maintain the space-about dimensions of the sheets at their extremities. At the front and rear solid spacing members seal the passageways 58 and 60 from the front and rear panels 48 and 50. At the top and bottom, alternate corrugated and solid spacing members allow passageways 58 open access to the steam receiving inlet plenum 24 at the top end and the hot water well 28 at the bottom end, while closing off access of passageways 60 to these same plenum areas. Similarly, at the location of the inlet and outlet ammonia plenums 34 and 40, alternate corrugated and solid spacing members allow passageways 60 access to these plenums while closing access of passageways 58. In this way, steam entering plenum 24 is able to move downward through passages 58 where, as will be seen, it is condensed for ultimate delivery in the form of water to the hot water well at the bottom ends of these passages. At the same time, the top ends of passages 60 are closed to plenum 24 but are open into ammonia outlet plenum 40 and inlet plenum 36 at their top and bottom ends, respectively. As a result, liquid ammonia entering plenum 36 moves vertically up passageways 60 and ultimately out of plenum 40.

In a preferred embodiment of the present invention, each passageway 58 and 60 includes a corrugated sheet extending its entire length, from inlet plenum 24 to hot water well 28 in the case of each passageway 58 and from inlet plenum 36 to outlet plenum 40 in the case of each passageway 60. Each corrugated sheet 64 is placed within its passageway such that its corrugations run with the latter, thereby dividing each passageway into a plurality of smaller sub-passages 58' in the case of passageways 58. In the case of passageways 60, corrugated sheets 62 run with the length of passageways 60 except at the ends where they are cut and oriented in such a way as to form subpassageways 60' which turn the flow at right angles; at the bottom from the horizontal flow originating from inlet plenum 36 to a vertical direction, and at the top from a vertical direction to a horizontal flow out through the outlet plenum 40. The sub-passages 58' extend between inlet plenum 24 and hot water well 28 and sub-passages 60' extend from inlet plenum 36 to outlet plenum 40. As a result, steam moves downward through the sub-passages 58' and ammonia moves upward through sub-passages 60', as best illustrated by means of the arrows in FIGS. 6, 7 and 9.

The corrugated sheets just described serve several purposes. First, they serve to add structural rigidity to the overall module and as a means of transversely spacing the various passageways. They also substantially increase the effective heat transfer surface area between the passageways 58 and 60, thereby improving both the ammonia boiling coefficient (extended surface) and steam condensation (thin film effects). These corrugated sheets can also be used to reduce the pressure drop across each overall passageway from its inlet plenum to its outlet plenum. For example, in the case of passageways 58, each corrugated sheet 64 can be made from a number of vertically stacked smaller sheets having sub-passages 58' which get larger cross-sectionally in incremental steps from inlet plenum 24 to hot water well 28. This effectively tapers each of these passageways inversely with the pressure build-up therein, thereby reducing the overall pressure difference across the passageway. The corrugated sheets in passageways 60 can be formed from smaller sheets providing similar tapering sub-passages 60' between inlet plenum 36 and outlet plenum 40. While this is the preferred way of tapering each overall passageway, it is possible to provide a continuous taper by appropriately positioning sheets 56 in skewed relationship to one another. This could be particularly possible in the embodiment illustrated since the passageways 58 would have to taper outwardly from their top ends to their bottom ends while the passageways 60 would taper outwardly from their bottom ends to their top ends.

Having described one of the steam condensing modules from a structural standpoint, attention is now directed to the preferred way in which this module is made. It starts with the flat sheets 56, corrugated sheets 64 and edge spacing members, either solid or corrugated as previously described, all of which are constructed of aluminum. While initially unconnected to one another they are assembled in a stacked manner with appropriately interspersed brazing sheets so as to build an unconnected module on its side. The deflecting corrugated sheets 62 are similarly placed into position in an unconnected manner. This enntire unconnected assembly is then fixedly connected as a single unit by means of furnace brazing which is well known in the art and therefore will not be described herein. It suffices to say that various aluminum sheets having different alloy contents are used so as to make furnace brazing possible. Module housing 46 comprised of panels 48, 50 and 52 may be incorporated in this process but are preferably disengagably connected to the brazed structure by suitable means in order to easily gain access therein for purposes of maintenance.

While the furnace brazing process just described is the preferred way of making each steam condensing module 32, it is to be understood that the present invention is not limited to this particular method of assembly. Moreover, the modules themselves are not limited to aluminum sheets but would be constructed from other thermally conductive sheet material otherwise compatible with overall apparatus and with the present invention.

Returning to FIG. 2, each of the steam condensing modules 32 is shown in its operating position on an associated rack 44. With each module in this operating position, the top open ends of steam passageways 58 are placed in fluid communication with inlet plenum 24 and their bottom open ends automatically placed in fluid communication with hot water well 28. At the same time, the bottom open ends of ammonia passageways 60 are automatically placed in fluid communication with an inlet plenum 36 and the top ends of these passageways are automatically placed in fluid communication with an outlet plenum 40. In this way, steam moves down passageways 58 through sub-passages 58' and ammonia moves up passageways 60 through sub-passageways 60' in order to condense the steam. As stated previously, this downward movement of the steam/water allows the non-condensables to be moved down with it. The colder ammonia liquid at the bottom of passageway 58 aids in forcing the non-condensables out. If it is necessary or desirable to use only certain ones of the individual modules 32, their top and/or bottom ends can be closed by suitable end plates indicated at 70 in FIG. 2. As will be seen below, ammonia carrying conduit arrangements 42 and 44 also have means to prevent ammonia from entering or leaving individual modules.

Referring specifically to conduit arrangement 42, this arrangement is shown including a main conduit 72 extending from a source of liquid ammonia, for example the previously referred to cooling tower, to modules 32 where it extends between the two rows along the bottom ends of the latter. This conduit which carries the continuous supply of liquid ammonia is placed in fluid communication with ammonia inlet plenum 36 through a T-connection having a shut-off valve 76. A similar main conduit 78 located between modules 32 (at the top ends of the latter) and the source of ammonia (e.g. the cooling tower) is provided for directing ammonia vapor from outlet plenums 40. To this end, the conduit 78 is placed in fluid communication with the plenums 40 by means of T-connection 80 and a shut-off valve 82.

While conduit arrangement 44 can be provided as described above, that is, similar to arrangement 42, in a preferred embodiment of the present invention, arrangement 44 is configured to separate any liquid ammonia exiting plenum 40 from the ammonia vapor and to prevent the two phases from mixing with one another. To this end, a perforated pipe 84 smaller in cross-section than main conduit 78 is fixedly disposed in a suitable manner concentrically within the main conduit and preferably extends the entire length of the latter. In this way, as the combination liquid/vapor ammonia enters main conduit 78, it does so transverse to the axes of the main conduit and perforated pipe. As a result of centrifugal force, the liquid moves to the outside of conduit 78 while the ammonia vapor tends to remain in the center of perforated pipe 84. The perforated pipe itself serves to prevent the two from remixing together as they move through the conduit and pipe. In addition, it may be desirable to provide a separate conduit 86 in parallel relationship with main conduit 78 and placed in fluid communication with the latter by means of a series of cross—couplings 88 illustrated in FIG. 2. In this way, the liquid ammonia leaving apparatus 10 is entirely removed from the main conduit and the ammonia vapor therein. This liquid ammonia could be returned to the ammonia source or it could redirected into inlet conduit 72, although this is not shown.

What is claimed:

1. A steam condenser apparatus, comprising:

(a) housing means defining (i) a first inlet plenum for receiving a continuous supply of steam to be condensed, (ii) a second inlet plenum for receiving a continuous supply of liquid ammonia which is intended to condense said steam and thereby vaporize, (iii) a first outlet plenum for receiving water resulting from the condensation of said steam, and (iv) a second outlet plenum for receiving said ammonia after the latter has condensed said steam and has vaporized said second outlet plenum including an outlet arrangement for separating liquid ammonia from ammonia vapor;

(b) means for supporting a number of thermally conductive sheets in spaced-apart confronting relationship to one another within said housing means so as to define therebetween (i) a plurality of first passageways extending from said first inlet plenum to said first outlet plenum for passing steam and/or water therethrough from said first inlet plenum to said first outlet plenum, and (ii) a plurality of second passageways extending from said second inlet plenum to said second outlet plenum physically isolated from and disposed between respective ones of said first passageways for passing ammonia therethrough from said second inlet plenum to said second outlet plenum whereby to cause the steam in the adjacent first passageways to condense;

(c) means for directing a continuous supply of steam into said first inlet plenum for movement through said first passageways; and (d) means for directing a continuous supply of liquid ammonia into said second inlet plenum for movement through said second passageways.

2. An apparatus according to claim 1 wherein said sheets are furnace brazed together in said spaced-apart confronting relationship.

3. An apparatus according to claim 1 including corrugated means located within each passageway for dividing the latter into a plurality of cross-sectionally smaller passages extending between said first and second inlet and outlet plenums.

4. An apparatus according to claim 1 wherein said first outlet plenum is aligned vertically below said first inlet plenum and wherein said first passageways extend vertically therebetween whereby the steam and/or water moving through said first passageways does so only in a vertically dropping manner.

5. An apparatus according to claim 4 wherein said second inlet plenum is located in close proximity to said first outlet plenum and said second outlet plenum is located vertically above said second inlet plenum and in close proximity to said first inlet plenum and wherein said second passageways extend vertically, whereby said ammonia moves through said second passageways in a vertically upward direction.

6. An apparatus according to claim 1 wherein said ammonia outlet arrangement includes a main conduit and a cross-sectionally smaller perforated pipe disposed within said main conduit and serving as said separating means.

7. An apparatus according to claim 1 wherein said means for supporting said sheets to define said passageways and said housing means cooperate to form a module removably connected as a unit with the rest of the apparatus.

8. An apparatus according to claim 7 including a plurality of additional modules identical to said first-mentioned module and removably connected with the rest of the apparatus in the same manner as said first-mentioned plenum.

9. An apparatus according to claim 1 wherein each of said first and second passageways increases in size from its inlet plenum to its outlet plenum.

10. An apparatus according to claim 9 including corrugated sheets in each passageway for dividing the latter into a plurality of cross-sectionally smaller passages extending between the passageway inlet and outlet plenums, said passages incrementally increasing in size cross-sectionally from their inlet plenum to their outlet plenum.

11. A steam condenser apparatus, comprising:

(a) housing means defining (i) a first horizontally extending inlet plenum for receiving a continuous supply of steam to be condensed, (ii) a second horizontally extending inlet plenum located vertically below said first inlet plenum for receiving a continuous supply of liquid ammonia which is intended to condense said steam and thereby vaporize, (iii) a first horizontally extending outlet plenum aligned vertically below said first inlet plenum in close proximity to said second inlet plenum for receiving water resulting from the condensation of said steam, (iv) a second horizontally extending outlet plenum located vertically above said second inlet plenum adjacent said first inlet plenum for receiving said ammonia after the latter has condensed said steam and has vaporized, and (v) an ammonia outlet conduit arrangement connected with said second outlet plenum for carrying ammonia away from the latter, said conduit arrangement including an outer axially extending main conduit, means for directing the ammonia from said second outlet plenum into said main conduit in a direction normal to the axis of the latter whereby any liquid ammonia entering the main conduit does so about the outer periphery of the latter and any ammonia vapor entering the main conduit is directed toward the center of the latter, said conduit arrangement including a perforated pipe smaller cross-sectionally than said main conduit and disposed co-axially within the latter, said perforated pipe serving to keep said ammonia vapor from mixing with said liquid ammonia;

(b) a plurality of steam condensing modules located horizontally adjacent one another below the first inlet and second outlet plenum and above the first outlet and second inlet plenums, each module including a number of aluminum sheets connected together by means of furnace brazing in spaced-apart confronting relationship to one another so as to define therebetween (i) a plurality of first passageways extending from said first inlet plenum to said first outlet plenum for passing steam and/or water therethrough, each of said first passageways including corrugated sheet means located therein for dividing the passageway into a plurality of cross-sectionally smaller passages extending between said first inlet and outlet plenums, and (ii) a plurality of second vertically extending passageways extending from said second inlet plenum to said second outlet plenum physically isolated from and disposed between respective ones of said first passageways for passing ammonia therethrough whereby to cause the steam in the adjacent first passageways to condense, each of said second passageways including corrugated sheet means located therein for dividing the passageway into a plurality of cross-sectionally smaller passages extending between said second inlet and outlet plenums;

(c) means for directing a continuous supply of steam into said first inlet plenum for movement through said first passageway; and (d) means for directing a continuous supply of ammonia into said second plenum for movement through said second passageways.

12. A steam condenser apparatus, comprising:

(a) housing means defining (i) a first horizontally extending inlet plenum for receiving a continuous supply of steam to be condensed, (ii) a second horizontally extending inlet plenum located vertically below said first inlet plenum for receiving a continuous supply of liquid ammonia which is intended to condense said steam and thereby vaporize, (iii) a first horizontally extending outlet plenum aligned vertically below said first inlet plenum in close proximity to said second inlet plenum for receiving water resulting form the condensation of said steam, (iv) a second horizontally extending outlet plenum located vertically above said second inlet plenum adjacent said first inlet plenum for receiving said ammonia after the latter has condensed said steam and has vaporized, and (v) an ammonia outlet conduit arrangement connected with said second outlet plenum for carrying ammonia away from the latter, (b) a plurality of steam condensing modules located horizontally adjacent one another below the first inlet and second outlet plenum and above the first outlet and second inlet plenums, each module including a number of aluminum sheets connected together by means of furnace brazing in spaced-apart confronting relationship to one another so as to define therebetween (i) a plurality of first passageways extending from said first inlet plenum to said first outlet plenum for passing steam and/or water therethrough, each of said first passageways including corrugated sheet means located therein for dividing the passageway into a plurality of cross-sectionally smaller passages extending between said first inlet and outlet plenums, and (ii) a plurality of second vertically extending passageways extending from said second inlet plenum to said second outlet plenum physically isolated from and disposed between respective ones of said first passageways for passing ammonia therethrough whereby to cause the steam in the adjacent first passageways to condense, each of said second passageways including corrugated sheet means located therein for dividing the passageway into a plurality of cross-sectionally smaller passages extending between said second inlet and outlet plenums;

(c) means for directing a continuous supply of steam into said first inlet plenum for movement through said first passageway; and (d) means for directing a continuous supply of ammonia into said second plenum for movement through said second passageways.

* * * * *